US010954827B2

(12) United States Patent
Stone et al.

(10) Patent No.: US 10,954,827 B2
(45) Date of Patent: Mar. 23, 2021

(54) DESMODROMIC VALVE TRAIN

(71) Applicant: JAGUAR LAND ROVER LIMITED, Warwickshire (GB)

(72) Inventors: Roger Stone, Coventry (GB); Owen Evans, Coventry (GB); David Kelly, Coventry (GB); Richard Tyrrell, Coventry (GB)

(73) Assignee: JAGUAR LAND ROVER LIMITED, Coventry (GB)

( * ) Notice: Subject to any disclaimer, the term of this patent is extended or adjusted under 35 U.S.C. 154(b) by 0 days.

(21) Appl. No.: 16/333,063

(22) PCT Filed: Oct. 3, 2017

(86) PCT No.: PCT/EP2017/075035

§ 371 (c)(1),
(2) Date: Mar. 13, 2019

(87) PCT Pub. No.: WO2018/065386

PCT Pub. Date: Apr. 12, 2018

(65) Prior Publication Data

US 2019/0203616 A1 Jul. 4, 2019

(30) Foreign Application Priority Data

Oct. 6, 2016 (GB) ..... 1616954.2
Oct. 6, 2016 (GB) ..... 1616958.3

(51) Int. Cl.
*F01L 1/34* (2006.01)
*F01L 1/30* (2006.01)
(Continued)

(52) U.S. Cl.
CPC *F01L 1/30* (2013.01); *F01L 1/18* (2013.01); *F01L 1/185* (2013.01); *F01L 9/04* (2013.01); *F01L 2009/0411* (2013.01)

(58) Field of Classification Search
CPC ..... F01L 1/30; F01L 1/18; F01L 1/185; F01L 9/04; F01L 2009/0411
See application file for complete search history.

(56) References Cited

U.S. PATENT DOCUMENTS 3,463,131 A 8/1969 Dolby
6,941,910 B2 * 9/2005 Methley ..... F01L 13/0047 123/90.16

(Continued)

FOREIGN PATENT DOCUMENTS

EP 1818513 A2 8/2007
GB 1230307 4/1971

(Continued)

OTHER PUBLICATIONS

Combined Search and Examination Report under Sections 17 and 18(3) for Application No. GB1616958.3 dated Mar. 10, 2017.

(Continued)

*Primary Examiner* — Zelalem Eshete
(74) *Attorney, Agent, or Firm* — Carlson, Gaskey & Olds

(57) ABSTRACT

A desmodromic valve train (20) for an engine (40), comprising a valve actuator (100) arranged to actuate a valve (400) independently of the crank angle of the engine (40), wherein the desmodromic valve train (20) comprises: a load path arrangement comprising an input arranged to receive actuating force from the valve actuator (100), an output arranged to provide the actuating force to the valve (400), and mechanical advantage means arranged such that a first displacement, of the input, causes a second displacement, of the output, wherein the second displacement is a multiple of the first displacement, the multiple being within the range 1.3 to 1.95.

19 Claims, 5 Drawing Sheets

(51) Int. Cl.
*F01L 9/04* (2006.01)
*F01L 1/18* (2006.01)

(56) References Cited

U.S. PATENT DOCUMENTS

| | | | | |
|---|---|---|---|---|
| 2008/0035870 | A1* | 2/2008 | Wygnanski ..... | F01L 1/30<br>251/129.15 |
| 2008/0110425 | A1 | 5/2008 | Endoh et al. | |

FOREIGN PATENT DOCUMENTS

| | | | |
|---|---|---|---|
| JP | S6114410 | A | 1/1986 |
| WO | 2004/097184 | A1 | 11/2004 |
| WO | 2011/061528 | A | 5/2011 |

OTHER PUBLICATIONS

International Search Report and Written Opinion of the International Searching Authority for International application No. PCT/EP2017/075035 dated Dec. 21, 2017.

* cited by examiner

VIEW C

SECTION E-E

VIEW D

DETAIL F

DESMODROMIC VALVE TRAIN

TECHNICAL FIELD

The present disclosure relates to a desmodromic valve train. In particular, but not exclusively it relates to a desmodromic valve train for an engine of a vehicle.

Aspects of the invention relate to a desmodromic valve train, an engine and a vehicle.

BACKGROUND

A traditional reciprocating internal combustion engine uses valves (typically poppet valves) to control gas flow into and out of the cylinders, facilitating combustion. A valve train is a system that controls the operation of the valves.

An example valve train comprises a camshaft. The camshaft comprises one or more lobes. Each lobe pushes on a valve directly or indirectly to displace the valve from a closed position to an open position. The valve train comprises valve return springs. Each valve return spring biases the valve to displace the valve from the open position to the closed position when the lobe is no longer pushing the valve. The shape of the lobe and design of the valve return springs dictates the resulting displacement over time of the valve from its closed position.

It is an aim of the present invention to provide an improved valve train.

SUMMARY OF THE INVENTION

Aspects and embodiments of the invention provide a desmodromic valve train, an engine and a vehicle as claimed in the appended claims.

According to an aspect of the invention there is provided a desmodromic valve train for an engine, comprising:

- a first surface arranged to be actuated by a valve actuator arranged to actuate a valve independently of the crank angle of the engine, causing the first surface to move according to a first lift profile having a maximum displacement and a minimum displacement;
- a second surface arranged to actuate directly the valve in dependence on actuation of the first surface by the valve actuator, causing the second surface to move according to a second lift profile having a maximum displacement and a minimum displacement; and
- a load path arrangement for providing a load path from the first surface to the second surface, wherein the load path arrangement comprises mechanical advantage means arranged such that the maximum-to-minimum displacement of the second lift profile is up to 1.95 times greater than the maximum-to-minimum displacement of the first lift profile. For convenience this 1.95 ratio will be referred to as an upper limit of a 'lift ratio'.

The mechanical advantage means may be arranged such that the maximum-to-minimum displacement of the second lift profile is no less than 1.3 times greater than the maximum-to-minimum displacement of the first lift profile. This provides a lower limit for the lift ratio.

The upper limit and/or lower limit of lift ratio provides the advantage of optimizing error in the second lift profile, power consumption and system packaging. The error in the second lift profile arises from amplification of errors in the load path arrangement caused by a numerically high lift ratio. Errors can arise from design tolerances, elastic deflections of components or running clearances. Optimal error is achieved at a numerically low lift ratio. Optimal power consumption is however achieved at a numerically high lift ratio. This is because the displacement (cam lift) required from the valve actuator for exerting pushing and pulling forces is less than the required displacement of the valve, allowing the camshaft to have low rotational inertia, improving dynamics at high engine speeds. Optimal system packaging is also achieved at a numerically high lift ratio because the low cam lift displaces the first surface by a smaller swept angle, ensuring that adjacent mechanisms do not foul one another at a crowded location in the valve train. These advantages are significant effect in a desmodromic valve train, for reducing root-mean-square energy consumption by the valve actuator that accelerates and decelerates the camshaft.

The valve actuator may comprise an electromagnetic actuator. The valve actuator may be arranged to rotate a camshaft comprising a camshaft lobe for actuating directly the first surface.

The lift ratio range in conjunction with an electromagnetic actuator provides the advantage of a compact valve train and significantly low energy consumption. This is because the system inertia associated with low lift ratios (e.g. lower than 1.3) demands high root-mean-square power consumption, particularly because the electromagnetic valve actuator must accelerate and decelerate the camshaft. Without the limited lift ratio, the parasitic power consumption by the desmodromic valve train may impractically high and may require an oversized electromagnetic valve actuator for handling high currents. Larger electromagnetic valve actuators may be impractical to fit into a passenger vehicle engine bay.

The electromagnetic actuator provides further efficiency improvements. As valve timing is independent from engine crank rotation, valve timing can be finely and coarsely adjusted to occur at any point during a combustion cycle for increased power, increased efficiency or for other purposes.

The load path arrangement may be arranged to transmit pushing forces for pushing the valve away from its valve seat.

The lift ratio range advantageously applies to those parts of the load path arrangement that transmit pushing forces.

The load path arrangement may be arranged to transmit pulling forces for pulling the valve towards its valve seat.

The lift ratio range advantageously applies to those parts of the load path arrangement that transmit pulling forces.

The mechanical advantage means may comprise a plurality of rockers arranged in series, the plurality of rockers comprising a first rocker comprising the first surface, and a second rocker comprising the second surface. The first rocker may be an upper rocker, and the second rocker may be a lower rocker.

This provides the advantage of a greater degree of design freedom for packaging the valve train within a vehicle.

Each of the first rocker and the second rocker may be arranged to transmit pushing forces for pushing the valve away from its valve seat and to transmit pulling forces for pulling the valve towards its valve seat.

This provides the advantage of an efficient and lightweight system for desmodromic valve actuation.

The second rocker may have a mechanical advantage of less than one. The first rocker may have a mechanical advantage greater than a mechanical advantage of the second rocker.

This provides the advantage that the second rocker enables the lift ratio to be below the upper limit or within the limits, and the first rocker is arranged so that its swept path does not foul mechanisms of neighbouring load path arrangements for actuating neighbouring valves.

A first one of the rockers may be coupled to an output of the valve actuator, and a second one of the rockers may be coupled to the first rocker via a connecting rod. The second rocker may comprise a bearing for connection to the connecting rod.

The valve actuator may be configured to provide a rotational output.

The desmodromic valve train may comprise a valve, wherein: a first curved surface at an upper portion of an end of the valve is arranged to contact a pushing contact surface of a rocker, the contact enabling pushing of the upper portion of the end of the valve along a first axis, and enabling relative slippage between the pushing contact surface and the upper portion of the end of the valve; and a second curved surface at a lower portion of the end of the valve is arranged to contact a pulling contact surface of the rocker, the contact enabling pulling of the lower portion of the end of the valve along the first axis, and enabling relative slippage between the pulling contact surface and the lower portion of the end of the valve.

In at least one cross-section view, a portion of the first curved surface and a portion of the second curved surface may lie on the circumference of a same virtual circle. The first curved surface may be domed. The second curved surface may be domed.

The second curved surface may be part of a retainer portion arranged to be retained in position with respect to a valve stem of the valve via at least friction upon application of the pulling of the lower portion of the end of the valve. An interface between the retainer portion and the valve stem may be tapered, the direction of the taper being arranged such that the taper further resists sliding of the retainer portion upwardly towards the upper portion of the end of the valve upon application of the pulling of the lower portion of the end of the valve.

A rocker of the desmodromic valve train may be arranged to provide a coupling between a valve and the valve actuator, and arranged to rotate about a fulcrum in response to pushing force from the valve actuator and in response to pulling force from the valve actuator, and the rocker may comprise: an input portion for coupling to the valve actuator, arranged to receive the pushing force from the valve actuator and to receive the pulling force from the valve actuator; an output portion, spaced from the input portion, for coupling to the valve, wherein the output portion comprises a pushing contact surface and a pulling contact surface, wherein the pushing contact surface may be arranged to contact a first curved surface at an upper portion of an end of the valve, the contact enabling pushing of the upper portion of the end of the valve along a first axis, and enabling relative slippage between the pushing contact surface and the upper portion of the end of the valve, and wherein the pulling contact surface may be arranged to contact a second curved surface at a lower portion of the end of the valve, the contact enabling pulling of the lower portion of the end of the valve along the first axis, and enabling relative slippage between the pulling contact surface and the lower portion of the end of the valve.

The pushing contact surface and the pulling contact surface may be opposing and inwardly facing surfaces. The input portion and the output portion may be on a same side of the fulcrum. The input portion may be located between the output portion and the fulcrum. The pulling contact surface may be discontinuous and offset to either side of the first axis.

According to an aspect of the invention there is provided a desmodromic valve train for an engine, comprising a valve actuator arranged to actuate a valve independently of the crank angle of the engine, wherein the desmodromic valve train comprises: a load path arrangement comprising an input arranged to receive actuating force from the valve actuator, an output arranged to provide the actuating force to the valve, and mechanical advantage means arranged such that a first displacement, of the input, causes a second displacement, of the output, wherein the second displacement is a multiple of the first displacement, the multiple being within the range 1.3 to 1.95.

The valve actuator may be an electromagnetic valve actuator.

The valve actuator may be arranged to rotate a camshaft comprising one or more camshaft lobes for camming the input of the load path arrangement to cause the first displacement, of the input.

The second displacement, of the output, may be for pushing the valve away from its valve seat.

The second displacement, of the output, may be for pulling the valve towards its valve seat.

The mechanical advantage means may comprise a rocker arranged to enable, at least in part, the second displacement, of the output, to be the multiple within the range 1.3 to 1.95, of the first displacement, of the input.

The mechanical advantage means may comprise a plurality of rockers.

In a variation of the aspects disclosed above the multiple may be any value not limited to the ranges disclosed herein even if detrimental to lift profile error and/or power consumption. This is because other features of the valve train are also considered to be patentable in their own right.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described, by way of example only, with reference to the accompanying drawings, in which.

DETAILED DESCRIPTION

Figure 1:
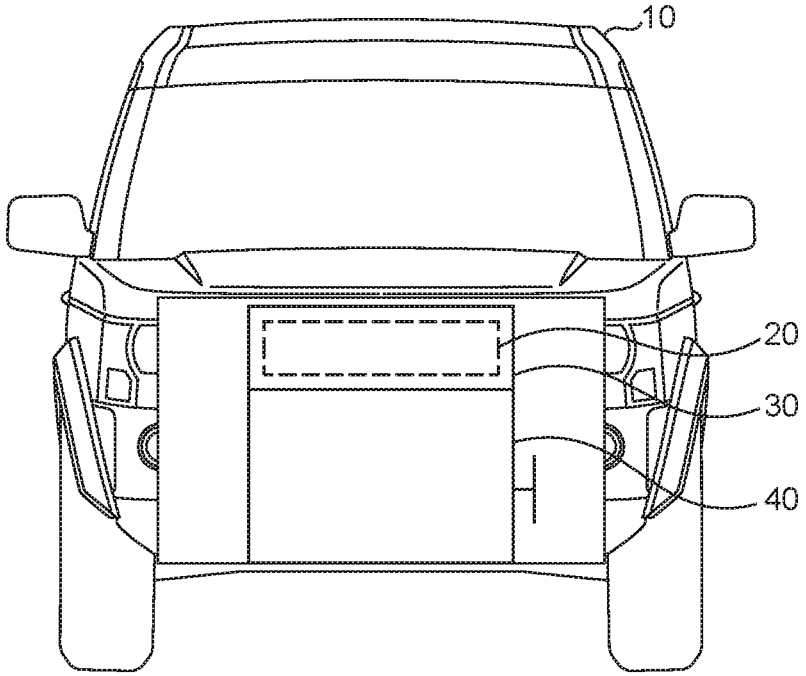
FIG. 1 illustrates an example of a vehicle.

The Figures illustrate a rocker apparatus 300 arranged to provide a coupling between a valve 400 and a valve actuator 100 for an engine 40, and arranged to rotate about a fulcrum 302 in response to pushing force from the valve actuator 100 and in response to pulling force from the valve actuator 100, the rocker apparatus 300 comprising: an input portion 308 for coupling to the valve actuator 100, arranged to receive the pushing force from the valve actuator 100 and to receive the pulling force from the valve actuator 100; an output portion 312, spaced from the input portion 308, for coupling to a valve 400, wherein the output portion 312 comprises a pushing contact surface 316 and a pulling contact surface 314, wherein the pushing contact surface 316 is arranged to contact a first curved surface 406 at an upper portion of an end 404 of the valve 400, the contact enabling pushing of the upper portion of the end 404 of the valve 400 along a first axis 418, and enabling relative slippage between the pushing contact surface 316 and the upper portion of the end 404 of the valve 400, and wherein the pulling contact surface 314 is arranged to contact a second curved surface 414 at a lower portion of the end 404 of the valve 400, the contact enabling pulling of the lower portion of the end 404 of the valve 400 along the first axis 418, and enabling relative slippage between the pulling contact surface 314 and the lower portion of the end 404 of the valve 400.

The Figures also illustrate a valve 400 for an engine 40, wherein: a first curved surface 406 at an upper portion of an end 404 of the valve 400 is arranged to contact a pushing contact surface 316 of a rocker apparatus 300, the contact enabling pushing of the upper portion of the end 404 of the valve 400 along a first axis 418, and enabling relative slippage between the pushing contact surface 316 and the upper portion of the end 404 of the valve 400; and a second curved surface 414 at a lower portion of the end 404 of the valve 400 is arranged to contact a pulling contact surface 314 of the rocker apparatus 300, the contact enabling pulling of the lower portion of the end 404 of the valve 400 along the first axis 418, and enabling relative slippage between the pulling contact surface 314 and the lower portion of the end 404 of the valve 400.

The Figures also illustrate a system 50 for actuating valves of an engine 40, the system 50 comprising: the valve actuator 100; the rocker apparatus 300 for actuation by the valve actuator 100; and the valve 400 for actuation by the rocker apparatus 300.

The Figures also illustrate a desmodromic valve train 20 for an engine 40, comprising: a first surface 206 arranged to be actuated by a valve actuator 100 arranged to actuate a valve 400 independently of the crank angle of the engine 40, causing the first surface 206 to move according to a first lift profile having a maximum displacement and a minimum displacement; a second surface 316 arranged to actuate directly the valve 400 in dependence on actuation of the first surface 206 by the valve actuator 100, causing the second surface 316 to move according to a second lift profile having a maximum displacement and a minimum displacement; and a load path arrangement for providing a load path from the first surface 206 to the second surface 316, wherein the load path arrangement comprises mechanical advantage means arranged such that the maximum-to-minimum displacement of the second lift profile is up to 1.95 times greater than the maximum-to-minimum displacement of the first lift profile.

The Figures also illustrate a desmodromic valve train 20 for an engine 40, comprising a valve actuator 100 arranged to actuate a valve 400 independently of the crank angle of the engine 40, wherein the desmodromic valve train 20 comprises: a load path arrangement comprising an input arranged to receive actuating force from the valve actuator 100, an output arranged to provide the actuating force to the valve 400, and mechanical advantage means arranged such that a first displacement, of the input, causes a second displacement, of the output, wherein the second displacement is a multiple of the first displacement, the multiple being within the range 1.3 to 1.95.

FIG. 1 illustrates an example of a vehicle 10 in which embodiments of the invention can be implemented. In some, but not necessarily all examples, the vehicle 10 is a passenger vehicle, also referred to as a passenger car or automobile. Passenger vehicles generally have kerb weights of less than 5000 kg. In other examples, embodiments of the invention can be implemented in engines for any application, for example engines for industrial vehicles, air or marine vehicles, or non-vehicle applications.

In FIG. 1 the vehicle 10 comprises: an engine 40 (which may be an internal combustion engine); a cylinder head 30 of the engine 40; and a valve train 20.

Figure 2:
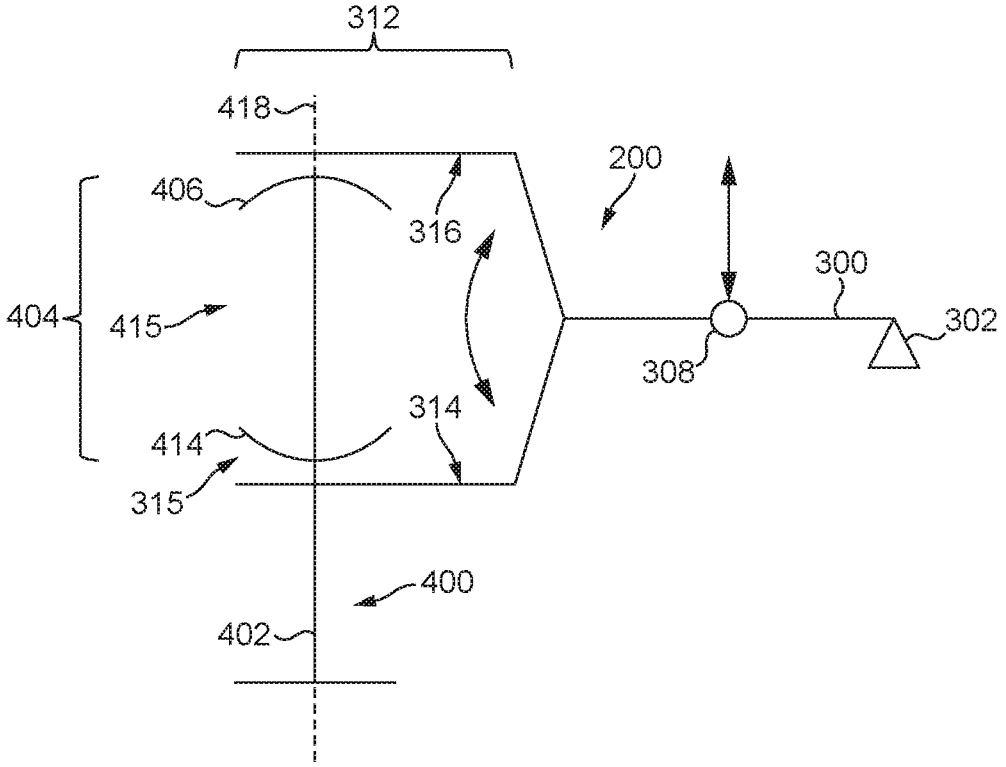
FIG. 2 illustrates an example of a valve and a rocker apparatus.

FIG. 2 illustrates a valve 400 and a mechanism 200 arranged to actuate the valve 400. The valve 400 and mechanism 200 are comprised in the valve train 20 when in use in the vehicle 10.

The function of the valve 400 is to block an aperture in a wall of a combustion chamber (not shown) of the engine 40 of FIG. 1 when the valve 400 is closed and therefore seated on a valve seat (not shown), and to open the aperture when the valve 400 is open (in an open position) and therefore spaced from its valve seat. When the valve 400 is moved (lifted) in to an open position, the position of the open valve 400 controls gas flow into or out of the cylinder through the aperture, facilitating combustion.

In the example of FIG. 2, but not necessarily all examples, the valve 400 is a poppet valve. The valve stem 402 of the poppet valve is arranged to couple with the mechanism 200.

The valve stem 402 is arranged to receive a pushing force and a pulling force from the mechanism 200, the forces being sufficient to overcome the inertia of the valve 400. Pushing force accelerates the valve 400 away from its closed position causing the valve 400 to open. Pulling force causes deceleration, slowing any movement of the valve 400 away from the closed position and increasing movement of the valve 400 towards the closed position.

In FIG. 2, but not necessarily all examples, the valve 400 is arranged to displace along a first axis 418. In some examples the first axis 418 is coaxial with the long axis of the valve stem 402 over at least a portion of the length of the valve stem 402. Cycles of pushing and pulling forces cause the valve 400 to reciprocate along the first axis 418.

If the pushing and/or pulling force includes a force component that is normal to the first axis 418, the valve 400 will be subjected to side loading. Side loading can cause the valve 400 to deviate from its intended path and/or increases wear on the valve 400.

The valve 400 of FIG. 2 is arranged to reduce, for example minimise, side loading. The valve 400 comprises a first curved surface 406 at an upper portion of an end 404 of the valve 400, and a second curved surface 414 at a lower portion of the end 404 of the valve 400. The end 404 of the valve 400 refers to the region of the valve 400, in particular the region of the valve stem 402, which is distal to a combustion chamber in use.

The first curved surface 406 is arranged to contact the mechanism 200 at a location on the mechanism 200 that provides pushing force to the valve 400. This location on the mechanism 200 is referred to as a pushing contact surface 316. The contact enables pushing of the upper portion of the end 404 of the valve 400 along the first axis 418 so that the valve 400 is opened. The contact also enables relative slippage between the pushing contact surface 316 and the upper portion of the end 404 of the valve 400. The relative slippage significantly reduces side loading on the valve 400 during valve pushing, so that any side loading would be negligible.

In some, but not necessarily all examples, the first curved surface 406 at the upper portion of the end 404 of the valve stem 402 is located at the furthest point (extremity) of the valve stem 402. At least part of the first curved surface 406 may define the extremity of the valve stem 402.

The convex curvature of the first curved surface 406, when it contacts the pushing contact surface 316, promotes the relative slippage during valve pushing. In some, but not necessarily all examples, the first curved surface 406 is domed. A domed surface refers to any surface that is curved in two dimensions. In other examples the first curved surface 406 is any other suitable curved shape, such as curved in one dimension (cylindrical).

In some, but not necessarily all examples, the diameter of the circumference of the first curved surface 406 is equal to the diameter of the valve stem 402. In other examples, these diameters are different. Similarly, the area defined by the circumference of the first curved surface 406 may be equal to or different from the area defined by the circumference of the valve stem 402 closest to the first curved surface 406.

In some, but not necessarily all examples, the radius of curvature of the first curved surface 406 is greater than the radius of the area defined by the circumference of the valve stem 402.

In some, but not necessarily all examples, the first curved surface 406 has rotational symmetry about the axis of the valve stem 402 (the first axis 418). In some, but not necessarily all examples, the first curved surface 406 has continuous curvature over its entire surface. In other examples the first curved surface 406 has discontinuous curvature and is defined by facets.

In some, but not necessarily all examples, the first curved surface 406 is a low friction surface for promoting the relative slippage. The low friction surface may result from an appropriate surface finishing process or from applying a low friction coating.

The second curved surface 414 is arranged to contact the mechanism 200 at a location on the mechanism 200 that provides pulling force. This location on the mechanism 200 is referred to as a pulling contact surface 314. The contact enables pulling of the lower portion of the end 404 of the valve 400 along the first axis 418 so that the valve 400 can be closed. The second curved surface 414 therefore enables desmodromic valve actuation. The contact also enables relative slippage between the pulling contact surface 314 and the lower portion of the end 404 of the valve 400. The relative slippage reduces side loading on the valve 400 during valve pulling.

The second curved surface 414 at the lower portion of the end 404 of the valve 400 is positioned along the end region of the valve stem 402 without being at the extremity of the valve stem 402. The second curved surface 414 is further from the extremity of the valve stem 402 than the first curved surface 406.

The convex curvature of the second curved surface 414, where it contacts the pulling contact surface 314, promotes the relative slippage during valve pulling. In some, but not necessarily all examples, the second curved surface 414 is cylindrical, but in other examples the second curved surface 414 could be any other suitable curved shape such as domed (curved in two dimensions). The second curved surface 414 may define a non-enclosed cylinder, resulting in a U-shaped second curved surface 414. The cylinder is optionally hollow.

In some, but not necessarily all examples, the second curved surface 414 extends orthogonally to the valve stem 402. Therefore the second curved surface 414 extends orthogonally to the first axis 418. For example, if the second curved surface 414 is cylindrical, the effective axis of the cylinder would extend orthogonally to the first axis 418.

In some, but not necessarily all examples, the radius of curvature of a portion of the second curved surface 414 is the same as the radius of curvature of a portion of the first curved surface 406. The second curved surface 414 and the first curved surface 406 are however separated by a discontinuity 415. There is no surface-to-surface contact between the first curved surface 406 and the second curved surface 414.

In some, but not necessarily all examples, the second curved surface 414 has continuous curvature across its entire surface. In other examples the second curved surface 414 has discontinuous curvature and is defined by facets.

In some, but not necessarily all examples, the second curved surface 414 is a low friction surface for promoting the relative slippage. The low friction surface may result from an appropriate surface finishing process or from applying a low friction coating.

The valve 400 may be manufactured (e.g. moulded) to include the second curved surface 414 or the second curved surface 414 may be attached to a manufactured valve 400. Examples will be provided later.

In FIG. 2, but not necessarily in all examples, the mechanism 200 comprises a rocker apparatus 300. The rocker apparatus 300 is arranged to provide a coupling between the valve 400 and a valve actuator 100 (not shown in FIG. 2). A valve actuator 100 represents any suitable actuator in the valve train 20 that receives energy from one or more sources external to the valve train 20 and supplies that energy in the form of kinetic energy to the mechanism 200. Example valve actuators are mechanical, electrical, hydraulic and pneumatic actuators.

As shown in FIG. 2, the coupling between the rocker apparatus 300 and the valve 400 is direct. Therefore the valve 400 and the rocker apparatus 300 make direct contact with each other. However the coupling between the rocker apparatus 300 and the valve actuator 100 can be direct or indirect.

The rocker apparatus 300 is arranged to rotate about a fulcrum 302 in response to pushing force from the valve actuator 100 and in response to pulling force from the valve actuator 100. Application of alternating pushing and pulling forces to the rocker apparatus 300 causes the rocker apparatus 300 to rotate back and forth in a rocking motion.

The rocker apparatus 300 comprises an input portion 308 for direct or indirect coupling to the valve actuator 100. The input portion 308 is arranged to receive the pushing force from the valve actuator 100 and to receive the pulling force from the valve actuator 100. The input portion 308 is spaced from the fulcrum 302.

In some, but not necessarily all examples, the input portion 308 comprises a bearing for enabling relative rotation between the rocker apparatus 300 and the element providing the pushing and pulling forces.

The rocker apparatus 300 comprises an output portion 312, spaced from the input portion 308 and from the fulcrum 302, for coupling to the valve 400.

The output portion 312 comprises the aforementioned pushing contact surface 316 and pulling contact surface 314.

In some, but not necessarily all examples, the pushing contact surface 316 is arranged to provide only positive force (including pushing force) to the first curved surface 406 and cannot provide any negative force (including pulling force). In some, but not necessarily all examples, the pulling contact surface 314 is arranged to provide only negative force (including pulling force) to the second curved surface 414 and cannot provide any positive force (including pushing force). Positive and negative are defined arbitrarily to represent forces of opposite signs.

In some, but not necessarily all examples, the pushing contact surface 316 and the pulling contact surface 314 are opposing and inwardly facing surfaces. The gap between the pushing contact surface 316 and the pulling contact surface 314 therefore defines a cavity 315 in which the end 404 of the valve 400 can be received. The gap is sized to enable the end 404 of the valve 400 to fit within the cavity. For example the size of the gap is equal to or slightly greater than the maximum separation of the first curved surface 406 from the second curved surface 414.

The pushing contact surface 316 and the pulling contact surface 314 can be straight or slightly curved. In some, but not necessarily all examples, at least a portion of the pushing contact surface 316 and at least a portion of the pulling contact surface 314 extend along parallel planes.

In the example of FIG. 2, but not necessarily in all examples, the input portion 308 is between the fulcrum 302 and the output portion 312. The distance of the input portion 308 from the fulcrum 302 is therefore less than the distance of the pushing contact surface 316 from the fulcrum 302, and is less than the distance of the pulling contact surface 314 from the fulcrum 302. The rocker apparatus 300 consequently has a mechanical advantage (of force applied) of less than one and is analogous to a class three lever. The rocker apparatus 300 therefore amplifies displacement of the input portion 308 into a greater displacement of the output portion 312 as it rotates about its fulcrum 302.

In another example, the output portion 312 is between the input portion 308 and the fulcrum 302, resulting in a class two lever and a mechanical advantage greater than one.

In the example of FIG. 2, the input portion 308 and the output portion 312 are on a same side of the fulcrum 302. This means that the effective phase separation between the input portion 308 and the output portion 312 during rotation of the rocker apparatus 300 is less than $\pi/2$ radians. In other words, movement of the input portion 308 in a first direction (e.g. downwards) results in displacement of both the input portion 308 and the output portion 312 in the first direction, and movement of the input portion 308 in a second opposite direction (e.g. upwards) results in displacement of both the input portion 308 and the output portion 312 in the second direction. However in an alternative example, the input portion 308 and the output portion 312 are on opposite sides of the fulcrum 302, resulting in a class one lever.

Although FIG. 2 shows one rocker apparatus 300 for actuating one valve 400, in other examples the rocker apparatus 300 can comprise one or more additional pushing contact surfaces and pulling contact surfaces for actuating one or more additional valves in conjunction with the valve 400 shown in FIG. 2.

Although FIG. 2 shows the pushing contact surface 316 and the pulling contact surface 314 being opposed and facing each other, the first curved surface 406 and second curved surface 414 being located in the cavity 315 between the pushing contact surface 316 and the pulling contact surface 314, other arrangements are possible. For example the first curved surface 406 and second curved surface 414 could instead be opposed and facing each other, the pushing contact surface 316 and pulling contact surface 314 being located in a cavity between the first curved surface 406 and second curved surface 414.

A system 50 which implements the valve 400 and rocker apparatus 300 of FIG. 2 will now be described, with reference to FIGS. 3 to 5. Each system 50 is associated with a single valve 400, so the system 50 can be replicated as many times as necessary for actuating all the valves of the engine 40. To save space the system 50 may be banked (angled) with respect to the direction of gravity.

Figure 3:
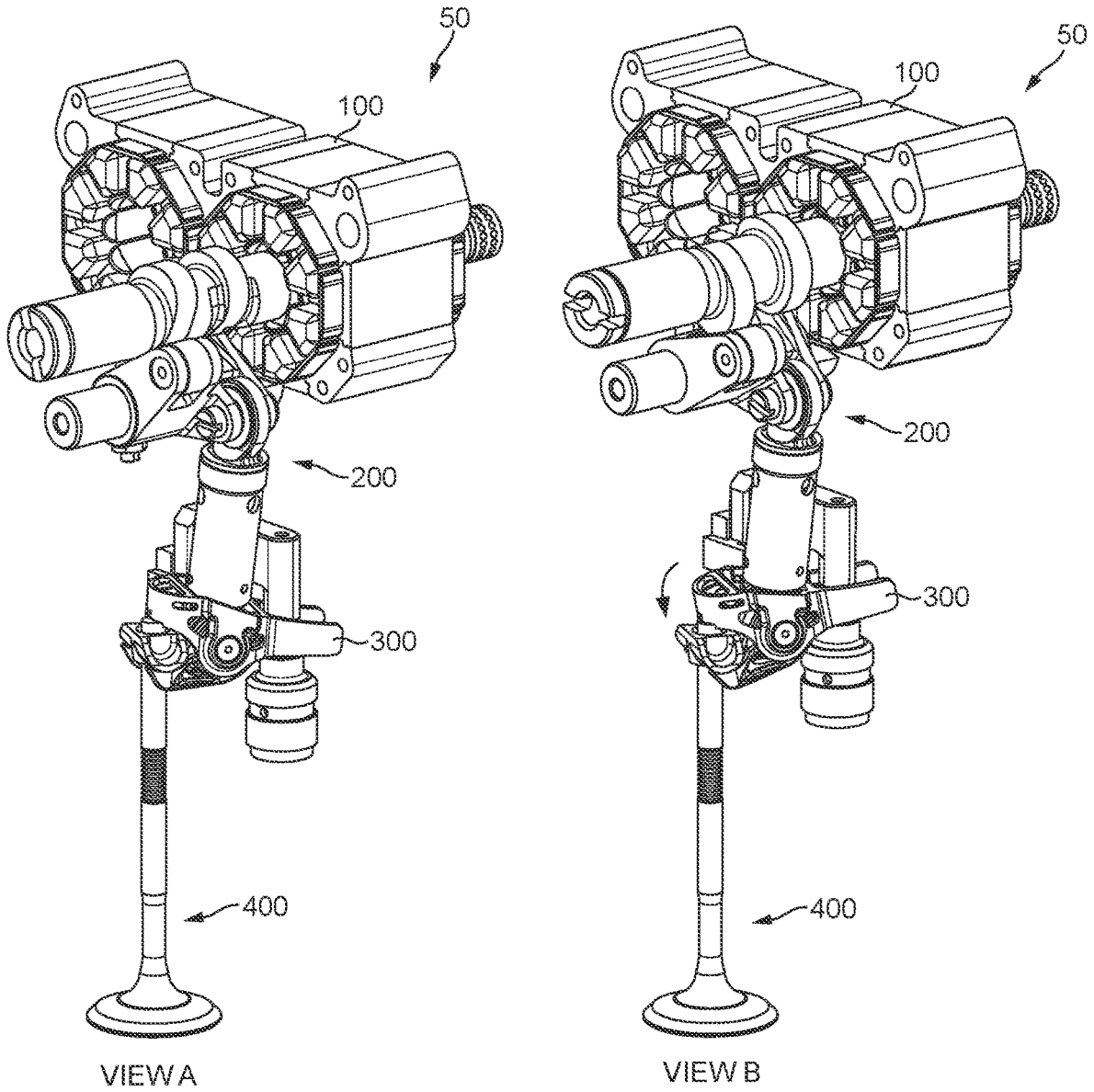
FIG. 3 illustrates an example of a system.
Figure 4:
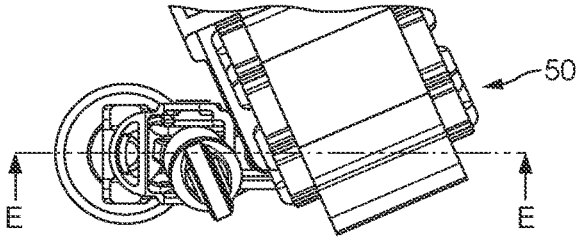
FIG. 4 further illustrates the example system of FIG. 3.
Figure 4:
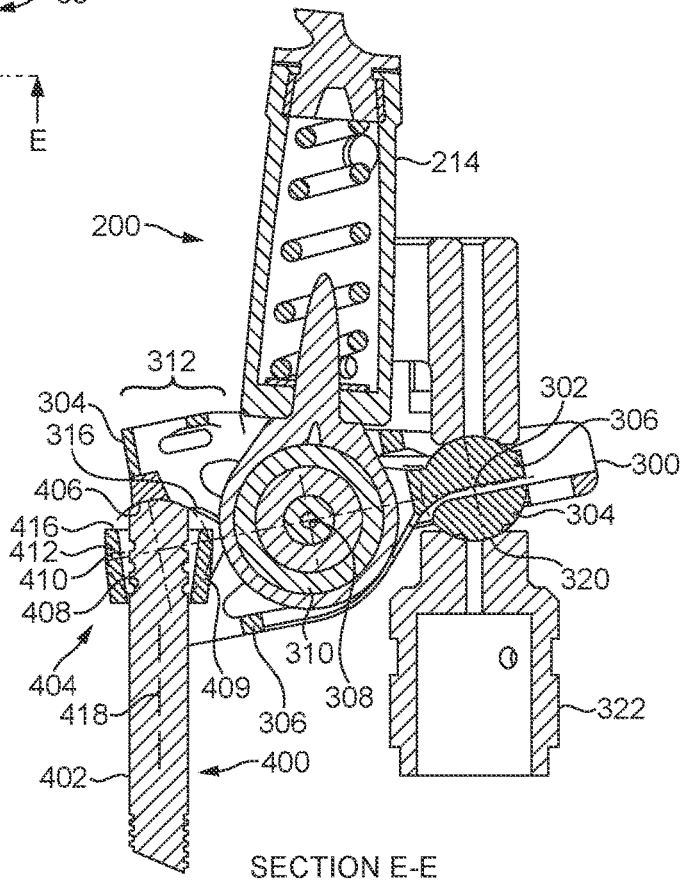
Figure 4:
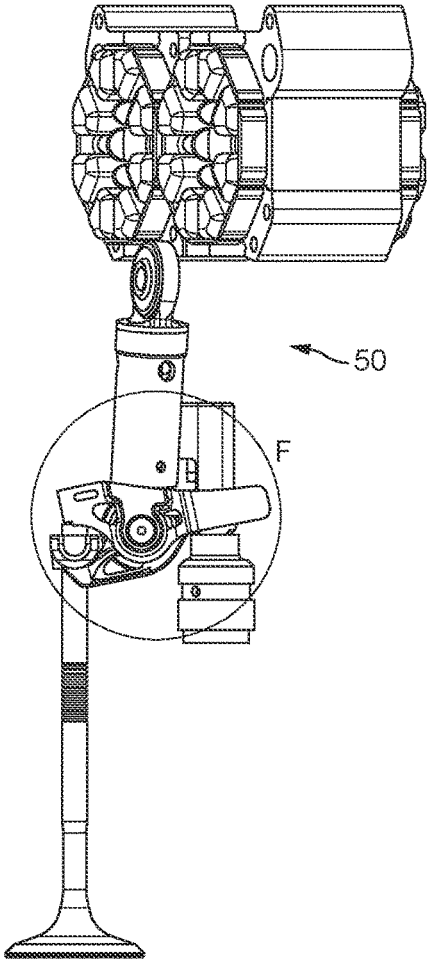
Figure 4:
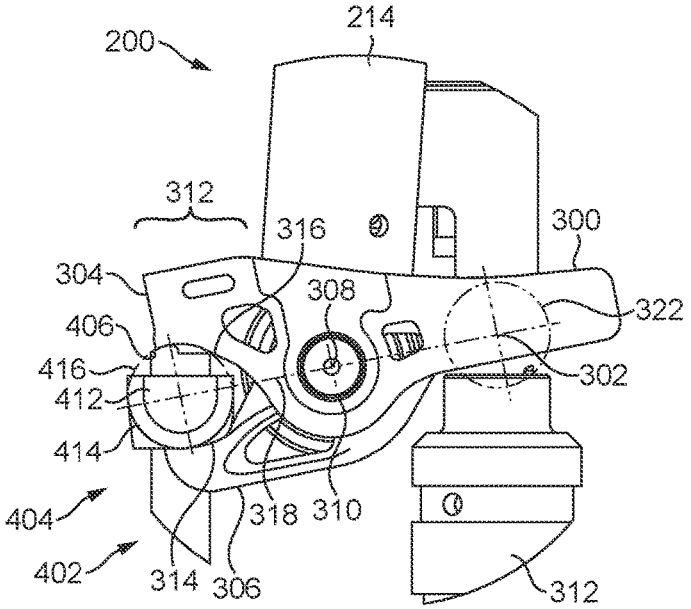
Figure 5:
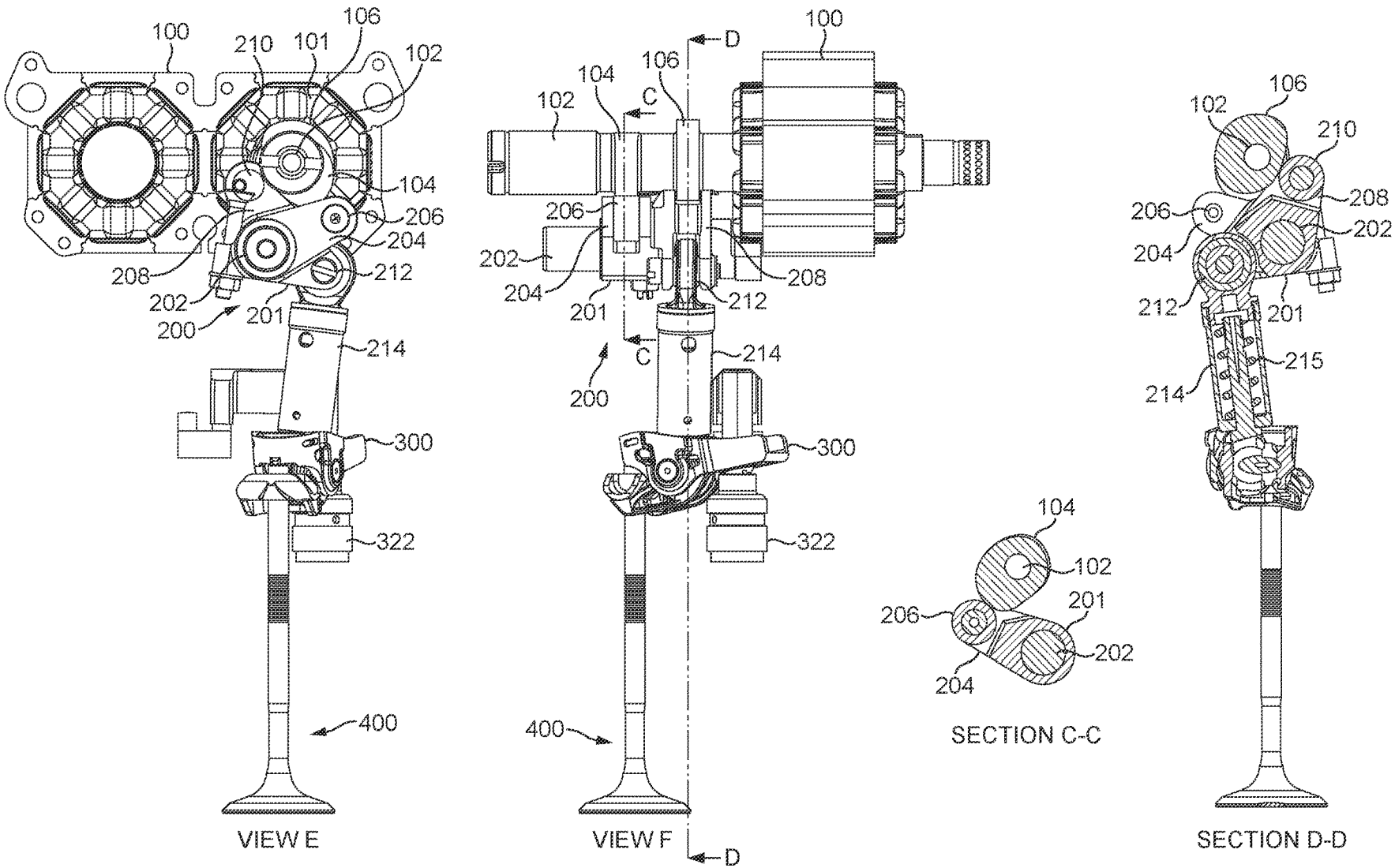
FIG. 5 further illustrates the example system of FIG. 3.

Reference numerals in FIGS. 3 to 5 corresponding to reference numerals in FIG. 2 refer to the same features as described in relation to FIG. 2.

FIGS. 3 to 5 present an overview of the system 50. The system 50 comprises a valve actuator 100, a mechanism 200 including the rocker apparatus 300, and a valve 400.

FIG. 4 presents additional more detailed views of the system 50, emphasising the end 404 of the valve 400 and the rocker apparatus 300. The end face of the valve stem 402 (at the extreme end of the valve stem 402) is domed to provide the first curved surface 406. A U-shaped cylinder, extending orthogonally to the valve stem 402, comprises the second curved surface 414.

The cylinder comprising second curved surface 414 is mounted to the valve stem 402 by means of a retainer portion 412. The retainer portion 412 is a rigid hollow sleeve for fitting over the end face of the valve stem 402 and sliding into position along the valve stem 402.

The retainer portion 412 is arranged to be retained in position with respect to the valve stem 402 via at least friction upon application of the pulling by the pulling contact surface 314. In FIG. 4, a collet 410 is also fitted over the valve stem 402. The collet 410 is fixed in place against the valve stem 402. The collet 410 comprises interlocking means 408 to interlock with the valve stem 402 and hold the collet 410 in place. The interlocking means 408 in FIG. 4 are male circumferential grooves on an interior surface of the collet 410 that interlock with female circumferential grooves in an exterior surface of the valve stem 402. The collet 410 is inversely tapered, increasing in diameter with increasing proximity to the end face of the valve stem 402. The exterior surface of the collet 410 is frustro-conical in shape. Therefore upon application of pulling force to the second curved surface 414 (upwards in FIG. 4), the retainer portion 412 and the collet 410 form a friction fit with one another at an interface 409 between them, the resulting friction and reaction force of the collet 410 at the interface 409 preventing the retainer portion 412 from being pulled off the end of the valve stem 402.

In some, but not necessarily all examples, the rocker apparatus 300 comprises a plurality of rocker arms. The rocker apparatus 300 of FIG. 4 comprises a pushing rocker arm 304 and a pulling rocker arm 306. The pushing rocker arm 304 comprises the pushing contact surface 316. The pulling rocker arm 306 comprises the pulling contact surface 314.

The pushing rocker arm 304 and the pulling rocker arm 306 are both operably coupled to the input portion 308 and to the fulcrum 302.

The pushing rocker arm 304 and the pulling rocker arm 306 extend angularly away from one another with increasing distance from the fulcrum 302, defining a cavity between the pushing rocker arm 304 and the pulling rocker arm 306 at the output portion 312. The end 404 of the valve 400 is received within the cavity. The angular separation between the pushing rocker arm 304 and the pulling rocker arm 306 with respect to the fulcrum 302 does not change during rocker apparatus 300 rotation.

The pushing contact surface 316 on the pushing rocker arm 304 and the pulling contact surface 314 on the pulling rocker arm 306 are opposing and inwardly facing surfaces, each facing into the cavity.

The pushing rocker arm 304 and the pushing contact surface 316 are centrally located such that the axis of the valve stem 402 (which may be the first axis 418) intersects the pushing contact surface 316.

The pulling rocker arm 306 is offset to both sides of the first axis 418. Therefore the pulling contact surface 314 is discontinuous and offset to both sides of the valve stem 402. The discontinuity provides a gap through which the valve stem 402 can extend. The pulling contact surface 314 is arranged to contact the cylindrical second curved surface 414 of the valve 400 at both sides of the discontinuity. The discontinuity is between the two points of contact.

In the rocker arm of FIG. 4, the input portion 308 comprises a bearing 310 (e.g. rose joint or roller bearing) between the fulcrum 302 and the output portion 312.

In the rocker arm of FIG. 4, the geometric centre of the fulcrum 302 is illustrated. The geometric centre of the fulcrum 302 may define the axis of rotation of the rocker apparatus 300.

The rocker arm of FIG. 4 comprises a fulcrum contact surface 320 arranged around the geometric centre of the fulcrum 302. The fulcrum contact surface 320 is a cylindrical or spherical surface arranged at a predetermined radial distance from the geometric centre of the fulcrum 302.

The fulcrum contact surface 320 is arranged to be supported by a support 322. The support 322 and the fulcrum contact surface 320 are arranged to resist unintended movement of the geometric centre of the fulcrum in use.

The support 322 may comprise adjusting means for adjusting the geometric centre of the fulcrum 302 in use. The adjustment ensures that operation of the system 50 remains within tolerances by accounting for component wear or other factors. The adjustment means may comprise a hydraulic lash adjuster.

The valve 400 and the rocker apparatus 300 as shown in FIGS. 3 to 5 have a special geometry that mitigates unsteady or imbalanced forces in use, for example mitigating forces pulling or pushing the pulling rocker arm 306 and the pushing rocker arm 304 away from each other. The special geometry is defined by any one or more of the following:

- The radius of curvature of at least a portion of the first curved surface 406 of the valve 400, at least a portion of the second curved surface 414 of the valve 400 and/or at least a portion of the fulcrum contact surface 320 are identical or substantially identical when the system 50 is viewed in a cross-section (SECTION E-E and DETAIL F of FIG. 4). The viewing direction is orthogonal to the first axis 418;
- In the cross-section, the portion of the first curved surface 406 and the portion of the second curved surface 414 lie on the circumference of a same virtual circle 416;
- In the cross-section, portions of the curved fulcrum contact surface 320 at opposing quadrants of the fulcrum contact surface 320 lie on the circumference of another virtual circle 323 having the same radius as the virtual circle 416;
- In the cross-section, a virtual line 318 extending from the centroid of the virtual circle 416 to the centroid of the another virtual circle 323 intersects the geometric centre of the input portion 308 (for example, through the axis of rotation of a bearing 310 at the input portion 308).

FIG. 5 presents additional more detailed views of the system 50, emphasising the valve actuator 100 and other parts of the mechanism 200.

The mechanism 200 shown in FIG. 5 includes intervening components between the rocker apparatus 300 of FIGS. 2 to 4 and the valve actuator 100. Therefore the rocker apparatus 300 is regarded as being indirectly coupled to the valve actuator 100.

The mechanism 200 in FIG. 5 comprises two rockers 201, 300 including the rocker apparatus 300 of FIGS. 2 to 4. The rockers are coupled in series. The two rockers of FIG. 5 are coupled to each other by a connecting rod 214. The connecting rod 214 is arranged to transfer the pushing and pulling forces from one rocker to the other. In other examples more or fewer rockers can be provided.

In the example of FIG. 5 but not necessarily all examples, the mechanism 200, in particular the connecting rod 214, comprises compliant means 215. In FIG. 5 the compliant means 215 comprises a helical spring. The compliant means 215 in FIG. 5 transmits the pulling forces from one rocker to another. The compliant means 215 is arranged such that while the valve 400 is seated and is unable to be pulled any closer to its seat, the compliant means 215 will change length upon application of any undesired pulling force exerted by the valve actuator 100, therefore preventing damage while providing a greater degree of design freedom for the valve actuator 100.

The two rockers and the connecting rod 214 together form the mechanism 200 that defines a load path arrangement providing a load path for the pushing and pulling forces from the valve actuator 100 to the valve 400. In other examples the load path arrangement comprises more or fewer components.

The pushing and pulling forces are received by the rocker apparatus 300 after they have passed through the other rocker. Therefore the rocker apparatus 300 may be regarded as a second rocker and the other rocker as a first rocker 201.

The first rocker 201 is directly coupled to the valve actuator 100. Its design is dependent upon the design of the valve actuator 100.

In the example shown in FIG. 5, the first rocker 201 is mounted on a shaft 202. The shaft 202 is a fulcrum for the first rocker 201, enabling the first rocker 201 to rotate about the shaft 202 in response to pushing force from the valve actuator 100 and in response to pulling force from the valve actuator 100.

The first rocker 201 comprises a first rocker arm 204 and a second rocker arm 208.

The first rocker arm 204 of the first rocker 201 extends from the shaft 202 to a first follower 206. The first follower 206 is a bearing acting as a roller follower for following a camming surface and receiving the pushing force (input).

The second rocker arm 208 of the first rocker 201 extends from the shaft 202 to a second follower 210. The second follower 210 is a bearing acting as a roller follower for following a camming surface and receiving the pulling force (input).

The angular separation between the first rocker arm 204 and the second rocker arm 208 of the first rocker 201 with respect to the shaft 202 does not change during rotation of the first rocker 201. In FIG. 5 the angular separation is greater than zero but in other examples the angular separation could be zero—this depends on the design of the valve actuator 100.

The first rocker arm 204 and the second rocker arm 208 of the first rocker 201 are both operably coupled to the shaft 202 and to an output 212 (for example a bearing or rose joint) of the first rocker 201 that attaches to an end of the connecting rod 214.

In FIG. 5, the first rocker arm 204 and the second rocker arm 208 of the first rocker 201 are separated from one another along the length of the shaft 202.

In the first rocker 201 of FIG. 5, the first rocker arm 204 and the output 212 are on a same side of the shaft 202. This means that the effective phase separation between the first rocker arm 204 and the output 212 during rotation of the first rocker 201 is less than $\pi/2$ radians. In other words, movement of the first rocker arm 204 in a first direction (e.g. downwards) results in displacement of the output 212 in the first direction, and movement of the first rocker arm 204 in a second opposite direction (e.g. upwards) results in displacement of the output 212 in the second direction.

In the first rocker 201 of FIG. 5, the second rocker arm 208 and the output 212 are on opposite sides of the shaft 202. This means that the effective phase separation between the second rocker arm 208 and the output 212 during rotation of the first rocker 201 is greater than $\pi/2$ radians. In other words, movement of the second rocker arm 208 in a first direction (e.g. downwards) results in displacement of the output 212 in a second opposite direction (e.g. upwards), and movement of the second rocker arm 208 in the second direction results in displacement of the output 212 in the first direction.

The valve actuator 100 shown in FIG. 5 will now be described. The valve actuator 100 has a design that complements the above-described first rocker 201.

In FIG. 5, the valve actuator 100 comprises an electromagnetic valve actuator 101. The electromagnetic valve actuator 101 in FIG. 5 comprises a rotor-stator pair for providing a rotating output. However, in other examples the electromagnetic valve actuator 101 can be for providing a linear output (for example a solenoid that causes linear actuation of a plunger).

FIG. 5 shows a rotor shaft 102 providing two functions. The rotor shaft 102 firstly acts as the rotor of the electromagnetic valve actuator 101. The rotor shaft 102 secondly acts as a camshaft for actuating the mechanism 200 by camming action, causing pushing and pulling forces to be transferred through the mechanism 200.

The electromagnetic valve actuator 101 is arranged to cause the rotor shaft 102 to perform a full rotation about the axis of the rotor shaft 102 (full rotation mode). In some, but not necessarily all examples, the electromagnetic valve actuator 101 is arranged to provide a 'bounce mode' that causes the rotor shaft 102 to perform a partial rotation in one direction of rotation (e.g. clockwise) followed by a partial rotation in the reverse direction of rotation (e.g. anti-clockwise). Bounce mode causes partial valve opening, while full rotation mode causes full valve opening.

The rotor shaft 102 (camshaft) in FIG. 5 comprises an acceleration lobe 104 (for pushing forces) and a deceleration lobe 106 (for pulling forces). The acceleration lobe 104 is arranged to directly contact the first follower 206 on the first rocker arm 204 of the first rocker 201. The deceleration lobe 106 is arranged to directly contact the second follower 210 on the second rocker arm 208 of the first rocker 201.

The rotor shaft 102 is arranged such that when the acceleration lobe 104 pushes the first follower 206 on the first rocker arm 204 of the first rocker 201, the first rocker 201 rotates about the shaft 202 in a first direction of rotation (e.g. clockwise), and when the deceleration lobe 106 pushes the second follower 210 on the second rocker arm 208 of the first rocker 201, the first rocker 201 rotates about the shaft 202 in a second opposite direction of rotation (e.g. anti-clockwise). In the example of FIG. 5, this is achieved by locating the rotor shaft 102 between the first follower 206 and the second follower 210.

In full rotation mode, the switchover between the acceleration lobe 104 pushing the first follower 206 and the deceleration lobe 106 pushing the second follower 210 is determined by the shapes and angular separations of the respective lobes 104, 106. The switchover enables pushing (acceleration) of the valve 400 to cease and pulling (deceleration) to commence, when in full rotation mode.

The amplitude of the valve lift is controlled by configuring the mechanical advantage in the load path arrangement.

Control of the mechanical advantage in the load path arrangement can provide advantages such as minimising power consumption by the system 50 and minimising errors in the final position of the valve 400.

The mechanical advantage in the load path arrangement determines the maximum-to-minimum displacements of components at certain points along the load path.

Maximum-to-minimum displacement refers to the resultant displacement of a point being measured between a maximum displacement of the point and a minimum displacement of the point. In the context of the present disclosure, the point is a point on the mechanism 200. Valve opening over time follows a generally Gaussian-shaped curve, and the point along the mechanism 200 would move according to a similarly-shaped curve. Maximum displacement can be regarded as peak valve opening at which direction reversal occurs of the point being measured, i.e. while the point is momentarily static. The peak is a point of inflexion on a displacement-time plot. Minimum displacement occurs at the instant at which the point being measured is static, e.g. the time on a displacement-time plot at which a zero gradient becomes positive/a negative gradient becomes zero.

Referring to the system 50 shown in FIGS. 3 to 5 during pushing (opening) of the valve 400, the first follower 206 can be regarded as a first surface arranged to be actuated by the valve actuator 100 (e.g. actuated directly by the acceleration lobe 104 on the rotor shaft 102). The lobe cams the first surface, causing the first surface to move according to a first lift profile having a maximum displacement and a minimum displacement. The shape of first lift profile, when plotted as displacement ($P_{1s}$) against normalised time (t) (e.g. FIG. 6A, 602 and FIG. 6B, 606), is near-representative of the shape of the lobe. Any differences would be down to tolerances and operating clearances. The relevant point on the first surface for accurately determining displacement is the contact point between the lobe and the first surface.

The pushing contact surface 316 of the rocker apparatus 300 can be regarded as a second surface arranged to actuate directly a valve 400 in dependence on actuation of the first surface by the valve actuator 100, causing the second surface to move according to a second lift profile having a maximum displacement and a minimum displacement. The shape of the second lift profile, when plotted as displacement ($P_{2s}$) against normalised time (t) (e.g. FIG. 6A, 604 and FIG. 6B, 608), is near-representative of the displacement of the valve 400. Any differences would be down to tolerances and operating clearances. The relevant location on the second surface for accurately determining displacement is the contact point between the second surface and the valve 400.

Figure 6A:
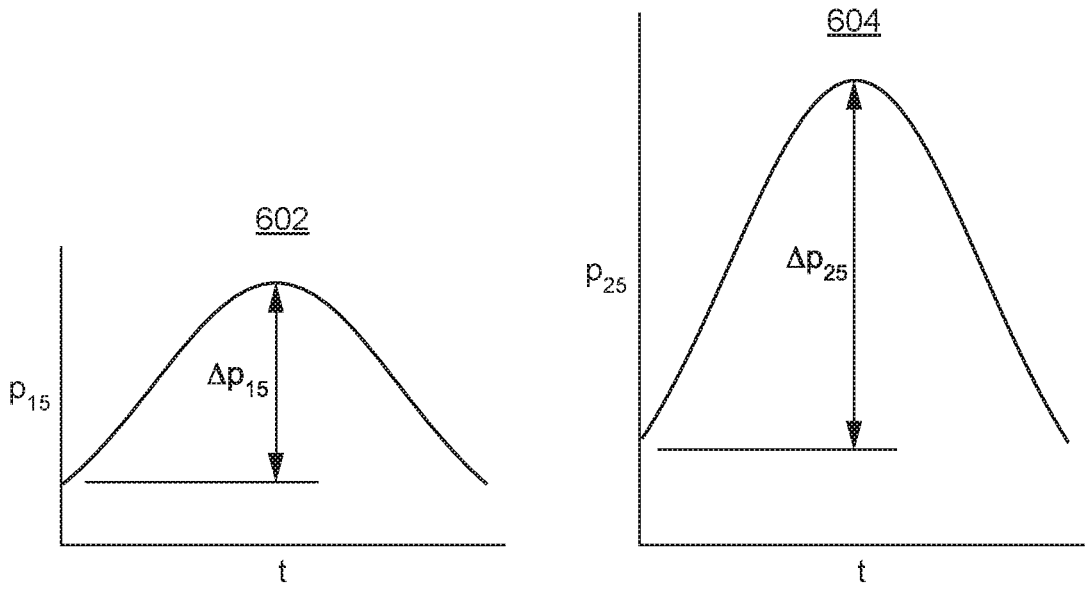
FIG. 6A illustrates an example of a first lift profile and a second lift profile and FIG. 6B illustrates another example of a first lift profile and a second lift profile.
Figure 6B:
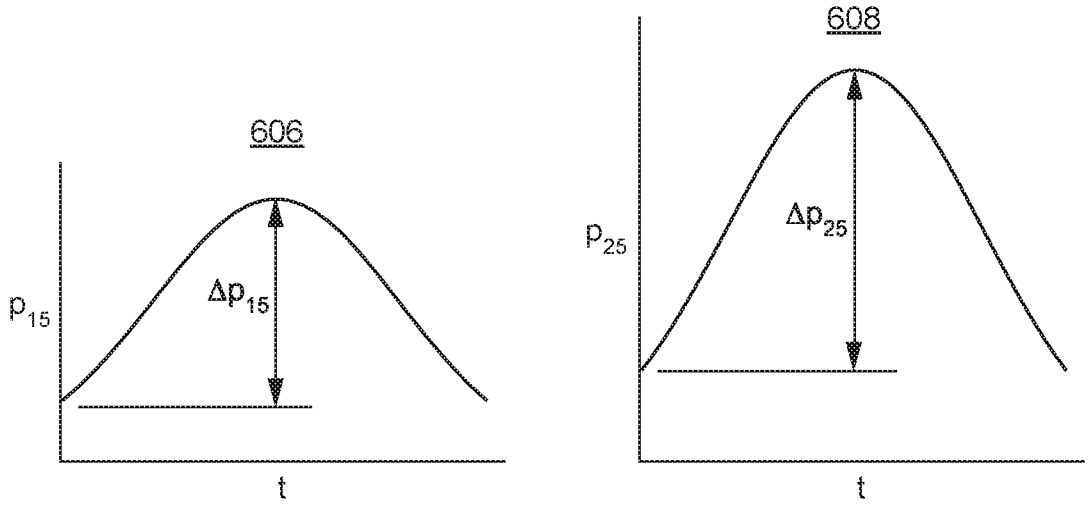

In this example and with reference to FIGS. 6A and 6B, the mechanical advantage in the load path arrangement is arranged such that during pushing (opening) of the valve 400, the maximum-to-minimum displacement of the second lift profile ($\Delta P_{2s}$) is up to 1.95 times greater (FIG. 6A, 604 compared to 602), and optionally no less than 1.3 times greater (FIG. 6B, 608 compared to 606), than the maximum-to-minimum displacement of the first lift profile ($\Delta P_{1s}$).

Referring to the system 50 shown in FIGS. 3 to 5 during pulling (closing) of the valve 400, rather than pushing, the second follower 210 on the second rocker arm 208 of the first rocker 201 can be regarded as a first surface because it is actuated by the valve actuator 100 (e.g. camming of the second follower 210 by the deceleration lobe 106 on the rotor shaft 102). The pulling contact surface 314 of the rocker apparatus 300 can also be regarded as a second surface because it is arranged to actuate directly the valve 400. The first lift profile for pulling may be identical to or different from the first lift profile for pushing. In this example and with reference to FIGS. 6A and 6B, the mechanical advantage in the load path arrangement is arranged such that during pulling, the maximum-to-minimum displacement of the second lift profile ($\Delta P_{2s}$) is up to 1.95 times greater (FIG. 6A, 604 compared to 602), and optionally no less than 1.3 times greater (FIG. 6B, 608 compared to 606), than the maximum-to-minimum displacement of the first lift profile ($\Delta P_{1s}$).

For convenience, these 1.3 and 1.95 ratios will be referred to respectively as a lower limit and an upper limit of a 'lift ratio'. The lower limit and upper limit of lift ratio for pushing and/or pulling are applicable not only to the system 50 described in relation to FIGS. 2 to 5, but also to any other valve trains or desmodromic valve trains.

The upper limit and/or lower limit of lift ratio provides the advantage of optimizing error in the second lift profile, power consumption and system packaging. The error in the second lift profile arises from amplification of errors in the load path arrangement caused by a numerically high lift ratio. Errors can arise from design tolerances, elastic deflections of components or running clearances. Optimal error is achieved at a numerically low lift ratio. Optimal power consumption is however achieved at a numerically high lift ratio. This is because the displacement (cam lift) required from the valve actuator for exerting pushing and pulling forces is less than the required displacement of the valve, allowing the camshaft to have low rotational inertia, improving dynamics at high engine speeds. Optimal system packaging is also achieved at a numerically high lift ratio because the low cam lift displaces the first surface by a smaller swept angle, ensuring that adjacent mechanisms do not foul one another at a crowded location in the valve train.

In the system 50 illustrated in FIGS. 3 to 5, if the overall mechanical advantage of both the first rocker 201 and the rocker apparatus 300 is one, the lift ratio would be one. If the overall mechanical advantage of one or both of the first rocker 201 and the rocker apparatus 300 is less than one, the lift ratio would be greater than one. If the overall mechanical advantage of one or both of the first rocker 201 and the rocker apparatus 300 is greater than one, the lift ratio would be less than one. The mechanical advantages of the first rocker 201 and the rocker apparatus 300 can be identical or different. Differences may arise from packaging constraints and/or for achieving further reductions in inertia. In some, but not necessarily all examples, the mechanical advantage of the rocker apparatus 300 is less than the mechanical advantage of the first rocker 201, and may be less than one. This may be advantageous if the rocker apparatus 300 has more space to move than the first rocker 201 without fouling adjacent mechanisms, and the overall system inertia may be reduced. In some, but not necessarily all examples, the first rocker 201 has a mechanical advantage of one or greater than one for packaging reasons.

In some, but not necessarily all examples, there is provided a desmodromic valve train 20 for an engine 40. The desmodromic valve train 20 comprises a valve actuator 100 arranged to actuate a valve 400 independently of the crank angle of the engine 40. An example of a suitable valve actuator 100 is the electromagnetic valve actuator 101, because it is controlled by electrical current rather than by a belt or chain attached to the engine crank. The desmodromic valve train 20 comprises: a load path arrangement comprising an input arranged to receive actuating force from the valve actuator 100, an output arranged to provide the actuating force to the valve 400, and mechanical advantage means arranged such that a first displacement, of the input, causes a second displacement, of the output, wherein the second displacement is a multiple of the first displacement, the multiple being within the range 1.3 to 1.95.

In some, but not necessarily all examples, the input comprises the first follower 206 and/or the second follower 210. In some, but not necessarily all examples, the output comprises the pushing contact surface 316 and/or the pulling contact surface 314. In some, but not necessarily all examples, displacement of the pushing contact surface 316 (second displacement, pushing) is 1.3 to 1.95 times greater than displacement of the first follower 206 (first displacement, pushing), and/or displacement of the pulling contact surface 314 (second displacement, pulling) is 1.3 to 1.95 times greater than displacement of the second follower 210 (first displacement, pulling).

Although embodiments of the present invention have been described in the preceding paragraphs with reference to various examples, it should be appreciated that modifications to the examples given can be made without departing from the scope of the invention as claimed. For example the rocker apparatus 300 can be the only rocker in the mechanism 200. Elements of the first rocker 201 can therefore be present in the rocker apparatus 300 for ensuring compatibility with the valve actuator 100.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A desmodromic valve train for an engine including a valve actuator arranged to actuate a valve independently of a crank angle of the engine, the desmodromic valve train comprising:

a load path arrangement comprising an input arranged to receive actuating force from the valve actuator;

an output arranged to provide the actuating force to the valve; and mechanical advantage means arranged such that a first displacement of the input, causes a second displacement of the output wherein the second displacement is a multiple of the first displacement, the multiple being within a range from 1.3 to 1.95, wherein the mechanical advantage means comprises a rocker mounted on a shaft which is a fulcrum for the rocker enabling the rocker to rotate about the shaft in response to a pushing force from the valve actuator and in response to a pulling force from the valve actuator, wherein the rocker comprises a first rocker arm and a second rocker arm, the first rocker arm extending from the shaft to a first follower, the first follower acting as a roller follower for following a camming surface and receiving the pushing force, the second rocker arm extending from the shaft to a second follower, the second follower acting as a roller follower for following a camming surface and receiving the pulling force, wherein the first rocker arm and the second rocker arm are both operably coupled to the output.

2. A desmodromic valve train as claimed in claim 1, wherein the valve actuator is an electromagnetic valve actuator.

3. A desmodromic valve train as claimed in claim 1, wherein the valve actuator is arranged to rotate a camshaft comprising one or more camshaft lobes for camming the input of the load path arrangement to cause the first displacement of the input.

4. A desmodromic valve train as claimed in claim 1, wherein the second displacement of the output is for pushing the valve away from a valve seat or for pulling the valve towards the valve seat.

5. A desmodromic valve train as claimed in claim 1, wherein the rocker is arranged to enable, at least in part, the second displacement of the output to be the multiple within the range from 1.3 to 1.95 of the first displacement, of the input.

6. A desmodromic valve train as claimed in claim 1, wherein the mechanical advantage means comprises a plurality of rockers.

7. A desmodromic valve train as claimed in claim 6, wherein a first one of the rockers is coupled to an output of the valve actuator; and a second one of the rockers is coupled to the first rocker via a connecting rod.

8. A desmodromic valve train as claimed in claim 7, wherein the second rocker comprises a bearing for connection to the connecting rod.

9. A desmodromic valve train as claimed in claim 1, wherein the valve actuator is configured to provide a rotational output.

10. A desmodromic valve train as claimed in claim 1, comprising a valve and wherein:

a first curved surface at an upper portion of an end of the valve is arranged to contact a pushing contact surface of the rocker enabling pushing of the upper portion of the end of the valve along a first axis and enabling relative slippage between the pushing contact surface and the upper portion of the end of the valve; and a second curved surface at a lower portion of the end of the valve is arranged to contact a pulling contact surface of the rocker enabling pulling of the lower portion of the end of the valve along the first axis and enabling relative slippage between the pulling contact surface and the lower portion of the end of the valve.

11. A desmodromic valve train as claimed in claim 10, wherein at least one of the first curved surface and the second curved surface is domed.

12. A desmodromic valve train as claimed in claim 10, wherein the second curved surface is part of a retainer portion arranged to be retained in position with respect to a valve stem of the valve via at least friction upon application of the pulling of the lower portion of the end of the valve.

13. A desmodromic valve train as claimed in claim 12, wherein an interface between the retainer portion and the valve stem includes a taper, a direction of the taper being arranged such that the taper further resists sliding of the retainer portion upwardly toward the upper portion of the end of the valve upon application of the pulling of the lower portion of the end of the valve.

14. A desmodromic valve train as claimed in claim 1, wherein the rocker is arranged to provide a coupling between a valve and the valve actuator and arranged to rotate in response to a pushing force from the valve actuator and in response to a pulling force from the valve actuator;

the rocker comprises an input portion for coupling to the valve actuator arranged to receive the pushing force from the valve actuator and to receive the pulling force from the valve actuator; and an output portion, spaced from the input portion, for coupling to the valve, wherein the output portion comprises a pushing contact surface and a pulling contact surface;

the pushing contact surface is arranged to contact a first curved surface at an upper portion of an end of the valve enabling pushing of the upper portion of the end of the valve along a first axis and enabling relative slippage between the pushing contact surface and the upper portion of the end of the valve; and the pulling contact surface is arranged to contact a second curved surface at a lower portion of the end of the valve enabling pulling of the lower portion of the end of the valve along the first axis and enabling relative slippage between the pulling contact surface and the lower portion of the end of the valve.

15. An engine comprising the desmodromic valve train of claim 1.

16. A desmodromic valve train for an engine, comprising:

a first surface arranged to be actuated by a valve actuator arranged to actuate a valve independently of a crank angle of the engine causing the first surface to move according to a first lift profile having a first maximum-to-minimum displacement;

a second surface arranged to directly actuate the valve in dependence on actuation of the first surface by the valve actuator causing the second surface to move according to a second lift profile having a second maximum-to-minimum displacement; and a load path arrangement for providing a load path from the first surface to the second surface, wherein the load path arrangement comprises mechanical advantage means arranged such that the second maximum-to-minimum displacement is at least 1.3 and up to 1.95 times greater than the first maximum-to-minimum displacement, wherein the mechanical advantage means comprises a rocker mounted on a shaft which is a fulcrum for the rocker enabling the rocker to rotate about the shaft in response to a pushing force from the valve actuator and in response to a pulling force from the valve actuator, wherein the rocker comprises a first rocker arm and a second rocker arm, the first rocker arm extending from the shaft to a first follower, the first follower acting as a roller follower for following a camming surface and receiving the pushing force, the second rocker arm extending from the shaft to a second follower, the second follower acting as a roller follower for following a camming surface and receiving the pulling force, wherein the first rocker arm and the second rocker arm are both operably coupled to the output.

17. A desmodromic valve train as claimed in claim 16, wherein the mechanical advantage means is arranged such that the second maximum-to-minimum displacement is no less than 1.3 times greater than the first maximum-to-minimum displacement.

18. A desmodromic valve train as claimed in claim 16, wherein the mechanical advantage means comprises a plurality of rockers arranged in series, the plurality of rockers comprising a first rocker comprising the first surface, and a second rocker comprising the second surface.

19. A desmodromic valve train as claimed in claim 18, wherein at least one of the second rocker has a mechanical advantage of less than one; and the first rocker has a mechanical advantage greater than a mechanical advantage of the second rocker.

* * * * *